US008330612B2

(12) United States Patent
O'Neill et al.

(10) Patent No.: US 8,330,612 B2
(45) Date of Patent: Dec. 11, 2012

(54) CONTAINER SUITABLE FOR WET WIPES AND CORRESPONDING REFILL PACK THAT PROVIDE SENSORY PERCEPTIBLE EFFECTS

(75) Inventors: Kilian John O'Neill, Konigstein (DE); Michael Remus, Heidelberg (DE); Yolanda Christina Kennish, Frankfurt (DE)

(73) Assignee: The Procter & Gamble Company, Cincinnati, OH (US)

( * ) Notice: Subject to any disclaimer, the term of this patent is extended or adjusted under 35 U.S.C. 154(b) by 358 days.

(21) Appl. No.: 12/048,242

(22) Filed: Mar. 14, 2008

(65) Prior Publication Data

US 2008/0223869 A1 Sep. 18, 2008

(30) Foreign Application Priority Data

Mar. 14, 2007 (EP) ..... 07104130

(51) Int. Cl.
*G08B 21/00* (2006.01)
*A47K 10/24* (2006.01)

(52) U.S. Cl. ..... 340/686.4; 340/568.1; 340/572.8; 340/604; 221/46

(58) Field of Classification Search ..... 221/33, 221/45, 46, 2, 246, 9–11; 340/500, 540, 340/545.6, 686.4, 568.1–568.8, 572.8, 604
See application file for complete search history.

(56) References Cited

U.S. PATENT DOCUMENTS

| | | | | |
|---|---|---|---|---|
| 4,041,480 | A * | 8/1977 | Boyle | 221/6 |
| 6,084,526 | A * | 7/2000 | Blotky et al. | 340/691.6 |
| 6,354,462 | B1 | 3/2002 | Conran et al. | |
| 6,529,446 | B1 * | 3/2003 | de la Huerga | 368/10 |
| 6,749,319 | B1 * | 6/2004 | Muse | 362/154 |
| 7,490,733 | B2 * | 2/2009 | Tagliareni | 221/46 |
| 8,016,156 | B2 * | 9/2011 | Sawin et al. | 221/155 |
| 2004/0099678 | A1 * | 5/2004 | Windorski et al. | 221/33 |
| 2005/0156744 | A1 * | 7/2005 | Pires | 340/573.5 |
| 2005/0171634 | A1 * | 8/2005 | York et al. | 700/231 |
| 2006/0283752 | A1 * | 12/2006 | Alegre de Miquel | 206/494 |
| 2007/0081803 | A1 * | 4/2007 | Lindsay et al. | 392/392 |
| 2009/0177315 | A1 * | 7/2009 | Goeking et al. | 700/231 |
| 2010/0025416 | A1 * | 2/2010 | Sawin et al. | 221/2 |

FOREIGN PATENT DOCUMENTS

| | | | |
|---|---|---|---|
| EP | 1 717 162 | A1 | 11/2006 |
| WO | WO 2004/066800 | A1 | 8/2004 |

OTHER PUBLICATIONS

International Search Report, PCT/IB2008/050934, mailed Sep. 29, 2008.

European Search Report for Application No. 07104130.5-2303 dated Aug. 21, 2007.

* cited by examiner

*Primary Examiner* — Brian Zimmerman
*Assistant Examiner* — An T Nguyen
(74) *Attorney, Agent, or Firm* — Richard L. Alexander; Amy M. Foust; William E. Gallagher

(57) ABSTRACT

A container suitable for wet wipes that comprises at least one compatibility sensor, at least one output device and at least one triggering device and a compatible a refill pack of wipes comprising a compatibility actuator. The compatibility sensor of the container and compatibility actuator of the refill pouch are designed to interact with each other. The interaction enables the operation of the output device, which functions only when triggered by the triggering device. The output device is capable of producing a sensory perceptible effect. The container and refill pack together can form a kit.

11 Claims, 4 Drawing Sheets

CONTAINER SUITABLE FOR WET WIPES AND CORRESPONDING REFILL PACK THAT PROVIDE SENSORY PERCEPTIBLE EFFECTS

CROSS REFERENCE TO RELATED APPLICATION

This application claims priority to EPO Application No. 07104130.5, filed Mar. 14, 2007, the substance of which is incorporated herein by reference.

FIELD OF THE INVENTION

This invention relates to a container for wet wipes and a corresponding pack (or pouches) of wet wipes. The invention further relates to interaction between the two that enables the triggering of an output device capable of delivering sensory perceptible effects.

BACKGROUND OF THE INVENTION

Containers for the storing and dispensing of wet wipes are common on the market. Containers are designed to provide the best storage conditions and dispensing action for wipes. Consumers obtain one solidly constructed container with their first purchase of wipes and then subsequently purchase only refill packs of wipes when the supply of wipes sold with the container has been exhausted.

This strategy is desirable because the containers themselves are reusable. This saves money and reduces damage to the environment as individual consumers only need one or two containers per household. Also because the manufacturer does not need to provide a new container with each pack, the numbers of containers needed to be manufactured will be much lower. With lower volumes required, each container can also be therefore made to a higher quality and durability standard than would be economically viable if the container was to be replaced with each pack of wipes.

Containers for wet wipes have been described frequently in the art. The refill packs (or pouches) are simply a stack of wet wipes packaged in shrink wrap or an equivalent. This simplicity enables considerable cost savings to be passed on to the consumer.

Containers and refill packs are usually designed to fit both technically and commercially together. Dimensions, colors, icons, identification indicia, usage instructions and commercial messages are consistent between the two, enabling both an easy and efficient refill of the container by the refill pack as well as a clear identification of which refill pack should fit into which container.

However, the push to provide products of lowest possible cost and best convenience to the user, tends to bring uniformity and standardization in the overall appearance of the refill packs and of their corresponding containers. There is therefore a risk for human error in the use of refill packs with reusable containers.

For example hard surface cleaning wipes refill packs could generally fit into containers originally intended for baby wipe. Hard surface cleaning wipes can obviously comprise chemicals that are neither intended nor desirable for use on human skin. Similarly the reverse situation, inadvertent placement of a refill of baby wipes in a container for hard-surface cleaning is undesired. Attempting to clean a glass surface with a baby wipe containing skin moisturizers will leave oily residues on the surface of the glass.

Less dramatic, though still undesirable, is the accidental mix-up between a refill pack of wipes and a container, when both are compatible with human skin use but have different characteristics. For example regular scented baby wipes in a container intended for especially sensitive baby skin wipes that are unscented. Or more generally the unintentional placement of regular skin wipes into a container of hypo-allergenic skin wipes. A further example would be the use of wipes that require solid disposal (in regular waste) mistakenly placed in container for flushable toilet wipes (disposed of in a toilet).

This potential for error is even more pronounced because the recognition of an incorrect match between refill pouch and container cannot readily be determined once the wrong refill has been inserted into a package. In most situations the error will only be identified when the desired result is not achieved, or that the desired result is accompanied by undesired effects.

It would also be desirable to provide containers that efficiently help to reveal that the contents of the container are the variety of wipe indicated by the container, while keeping the physical and functional characteristics of the wipes container unaltered. This is important as the container can still be used for wipes of a different type as long as this is a deliberate and conscious decision.

It would be desirable to make a wipes container that can provide sensory perceptible outputs when in use.

It would therefore be highly desirable to have a wipes container that would provide certain sensory perceptible outputs only when the desired wipe refill pack is in place. This would provide a simple method for the user of the wipes in the container to be certain that the wipes are the type corresponding to the container.

SUMMARY OF THE INVENTION

The invention is directed to a container for wet wipes, a pack of wipes comprising a compatibility actuator and a kit comprising a container and pack of wipes with corresponding compatibility actuator.

The wipes container comprising, at least one compatibility sensor, at least one output device capable of producing a sensory perceptible effect and at least one triggering device. These are arranged such that the output device is only rendered operational when the compatibility sensor of the container interacts with the compatibility sensor of the corresponding pack of wipes and the output device is activated by the operation of the triggering device.

The pack of wipes possesses a compatibility of actuator capable of interacting with the compatibility sensor of the container.

The invention also includes a kit comprising a container and pack of wipes. The wipes container comprising, at least one compatibility sensor, at least one output device capable of producing a sensory perceptible effect and at least one triggering device. These are arranged such that the output device is only rendered operational when the compatibility sensor of the container interacts with the compatibility sensor of the corresponding pack of wipes and the output device is activated by the operation of the triggering device. The pack of wipes possesses a compatibility of actuator capable of interacting with the compatibility sensor of the container.

DETAILED DESCRIPTION OF THE INVENTION

Figure 1:
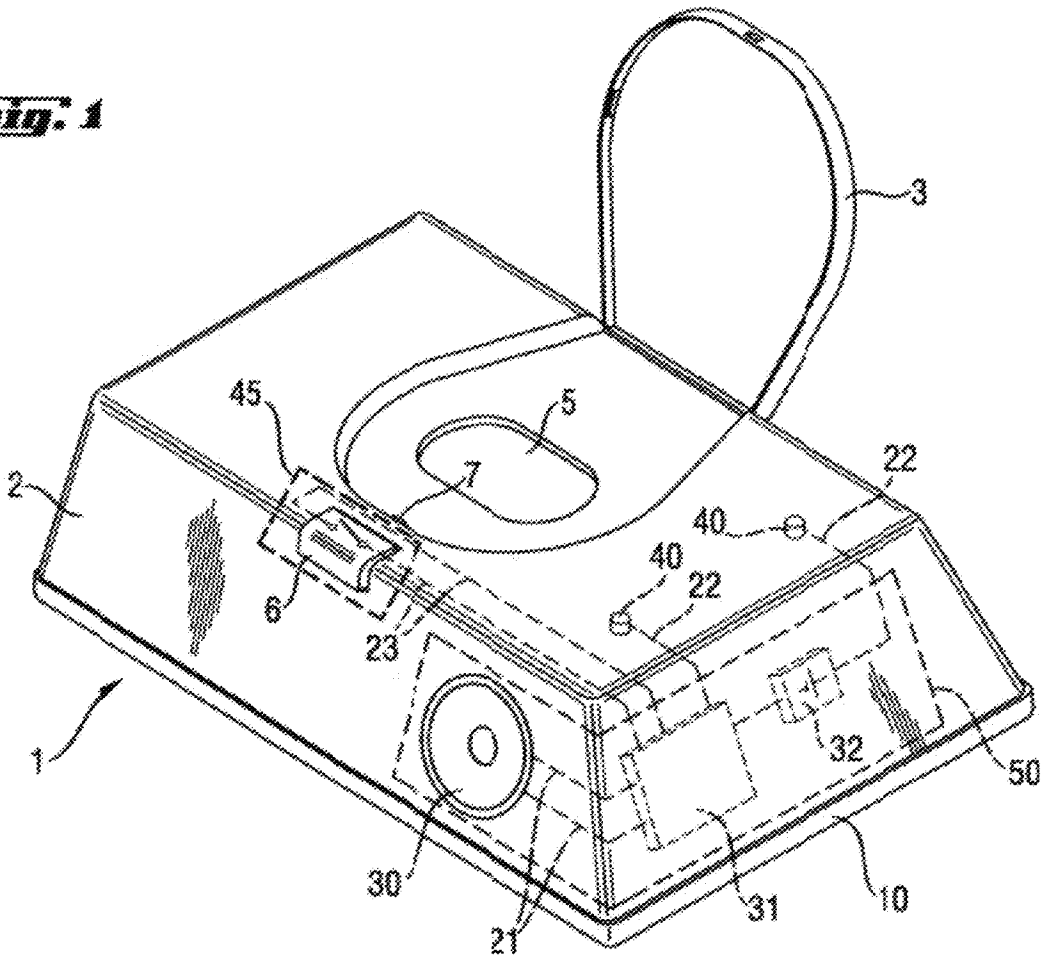
FIG. 1 shows a perspective of a container that is an embodiment of the invention wherein the output device is a loudspeaker and associated controller.

A "pack" or "refill pack" as used in the present invention is a packaging structure that can be made of a flexible material such as a soft polymeric film. A "pack" or "refill pack" encloses a stack of wipes. Packs are usually intended to be placed in an empty container however they can also be designed for a standalone dispensing without the corresponding container and have their own re-sealable orifice for dispensing of the wipes. The re-sealable portion can also be constructed from a flexible film wrap type material or fashioned from harder materials.

An "output device" as used in the present invention is any device capable of creating a sensory perceptible effect. The output device can be a distinct component and discrete from the container, non limiting examples would be loudspeakers, light bulbs, liquid crystal displays and projectors. The output device can also be continuous with and form part of the container, a non limiting example would be a closable window or clear portion of the container that would allow the viewing of a section of the refill pouch within. The output device will usually include further components, usually electronic, for the control and operation of the output device. Non-limiting examples are microprocessor chips and data storage components including disc storage devices and solid state memory. Optionally the further components may include a recording or other input device to enable the users to modify or completely change the form of the output. This will enable the personalization of the outputs for the individual user.

The output device can also include a power source for its operation, which will normally be a battery or cell. However the power supply may optionally include other sources of power such as solar panels.

A "triggering device" as used in the present invention is defined as the part, either integral or separate, of the container that activates the output device. Non limiting examples of triggering devices would be a motion sensor that detects individual wipe removal, or a simple switch on the container, such as a push button switch. The push button switch may be used solely for the purpose of triggering the output device or may be used in combination with another function, for example to release a lid mechanism. More than one triggering device may be used and this can allow for more than one way of activating the operative device. As a non-limiting example, if the button for the release of the lid opening assembly is a triggering device and there is a motion detector triggering device both the operation of the lid and the removal of a wipe may trigger the output device. The separate triggering devices may activate the same or a different response from the output device.

A "compatibility actuator" as used in the present invention is defined as the portion of the refill pack designed to interact with the compatibility sensor of the container. The compatibility actuator can be of an integral part of the refill part or an attached part provided with the refill pack. The interaction between the compatibility sensor and compatibility actuator can be mechanical, electrical, magnetic or by any other means.

A "compatibility sensor" as used in the present invention is defined as the portion of the container that interacts with the compatibility actuator of the desired wipes refill pack. An individual compatibility sensor may consist of a single component or be composed from several discrete but interrelated components.

The compatibility sensor is linked to the output device and controls its state of operability. The compatibility sensor only renders the output device operational in the presence of the correct compatibility actuator. The output device will not function when activated by the triggering device unless the compatibility sensor interacts with the correct compatibility actuator and renders the output device operational.

The connection between the compatibility sensor and the output device will usually be electronic and take the form of an electronic circuit. In other embodiments the compatibility sensor may also interact with the output device in a mechanical way or by any other means.

The container of the present invention may contain a plethora of different compatibility sensors. These will be designed to interact with different compatibility actuators of refill pouches of different types of wipes. The different sensors may activate different output devices or the sensors may activate a different output from the same output device or any combination thereof.

A "sensory perceptible effect" as used in the present invention is one capable of providing a visual, audible, olfactory or tactile or combination thereof stimulus to persons in the vicinity of the wipes container. The outputs are designed primarily to attract the attention of small children and may simply be entertaining but more desirably have some instructional aspect. The instructional aspect providing guidance on successful use of the product and general hygiene habits and where possible giving encouragement to the child to achieve this.

Non limiting examples of visual sensory effects or stimuli suitable for the present invention would be lighting effects, motion pictures, animations and holograms or combinations thereof. Non limiting examples of audible sensory effects or stimuli suitable for the present invention would be spoken voices, singing voices, sound effects and music or any combinations thereof.

EXAMPLE OF THE INVENTION

FIG. 1 shows an embodiment of a container 1 of the present invention. Container 1 consists of a removable base section 10, a top section 2 and a re-sealable lid 3 with button 6 to release the lid. The removable base 10 allows access to the container for inserting a fresh refill pack.

The top section 2 of the container has an opening 5 through which the wipes from the refill pack will be dispensed. The opening 5 is completely covered and sealed by the lid 3 of the container when closed, to prevent the wipe stack from drying out when not in use. Opening 5 of top section 2 of the container may correspond roughly to orifice 12 of refill pack 11. Orifice 12 may be resealable, as by flap 13.

In the container in FIG. 1 the output device 50 is made up of loudspeaker 30, controller 31 and battery power supply 32. The controller 31 contains all the necessary components for the operation of the loudspeaker, including data storage devices to digitally store the desired sound outputs and a digital to analog converter (DAC) necessary to convert the digital recording into an analogue output. Digitally stored sound would be one embodiment however alternative embodiments utilizing analogue tape or equivalent for sound storage could also be envisaged.

In the embodiment of a container in FIG. 1, button 6 forms the triggering device for the activation of the output device 50. Button 6 forms part of the lid opening assembly and controls the release of lid 3 from a closed to an open position. The lid may be held shut under elastic tension so that it relaxes to an open position when the button 6 is depressed that releases the lid from the catch 7.

The button 6 acts as the triggering device 45 as it also completes circuit 23 to the control unit 31 of the output device 50. The pushing of button 6 releases the lid and connects the circuit to the control unit. The control unit 31 can then respond to the operation of the lid 3 and give the required output signal to the loudspeaker 30, for example, via circuit 21.

The triggering device 45 in FIG. 1 is a simple switch and activates the output device when the lid of the container is opened. However, further embodiments can be imagined where the output device can be triggered by the closing as well as opening of the lid with two separate connections being made. The sensory output can then be different depending on the action of the lid. For example, when the lid is closed the output may consist of a congratulatory message and a request for a child to wash their hands before leaving the bathroom, for example. When the lid is opened, the message or output might relate to the use of the wipe and its successful disposal.

In an alternative embodiment the triggering device 45 could take the form of a simple switch or button so that the output can be activated without opening the container. In a further embodiment the triggering device might take the form of a motion sensor in the top orifice of the container. This would detect the motion of a wipe being dispensed and activate the output device.

In further embodiments the container may have multiple triggering devices, with each capable of generating different outputs if required, from the output device. As an example, the container will have the release button for the lid assembly and a motion sensor in the top orifice acting as triggering devices. The output can then be different depending on the trigger used.

The control unit of the output device is coupled to a battery 32 via circuit 22. The circuit is open and ends at sensor 40. Sensor 40 consists of two electrical contact points that are fixed at the top of the inside of the container. The output device 50 will not operate when the container is empty or incorrectly filled with an undesired refill pouch.

Figure 2:
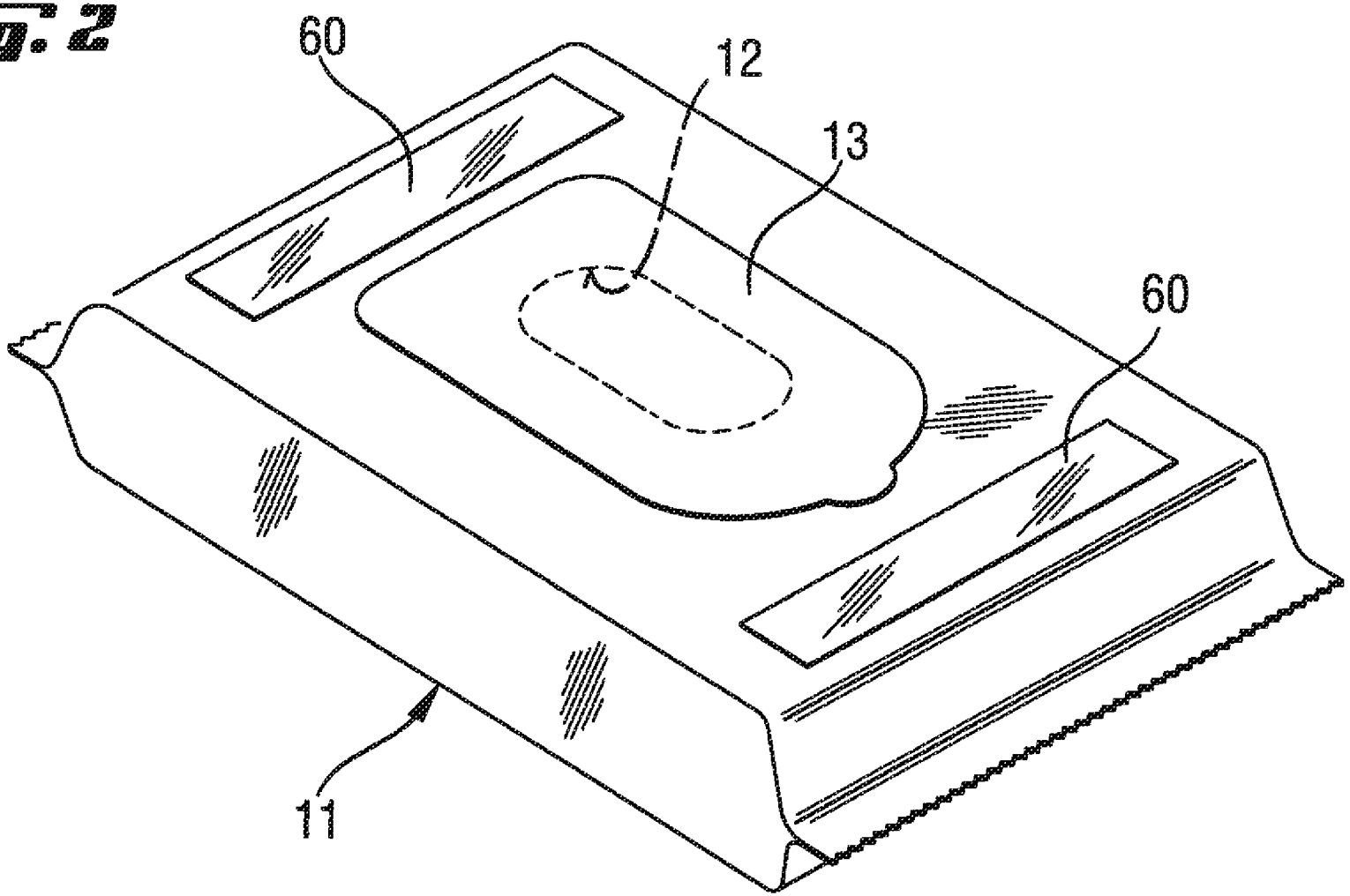
FIG. 2 shows a pack of wipes with a compatibility actuator designed to interact with the compatibility sensor of the container in FIG. 1

The refill pack in FIG. 2 has two compatibility actuators 60 that are designed to interact with compatibility sensor 40 of the container. The compatibility actuators 60 in FIG. 2 consist of two conducting strip on the top surface of the refill pack 11. The compatibility actuator may be constructed from a metallic foil or conducting inks or by any other means to conduct electricity. The foil, if used may be an integrated part of the packaging or may be attached by any means to the surface of the packaging.

The arrangement of the compatibility sensor 40 and the location of compatibility actuators 60 in FIGS. 1 and 2 are only one example. Other arrangements of sensor 40 and compatibility actuators 60 are possible. In one possible embodiment of the invention the container could be designed as a multi purpose wipes container and would have multiple sensors in different locations. Each sensor would be able to detect the compatibility actuator from a different type of wipes. This could enable a different output response dependent on the type of wipes inserted. For example, for a flushable wipes refill, the output instructing on disposal would inform of WC disposal. However with the detection of a non flushable wipes pack, the output may give solid waste disposal instructions.

With the refill pack 11 in FIG. 2 inserted into the container 1 in FIG. 1, circuit 22 is completed. The compatibility sensors 40 are engaged by compatibility actuator 60 and current can reach the control unit 31 of the output device 50. Operation of the lid, to access the wipes then triggers the controller via lid release button 6, completes circuit 23. The controller then directs the desired stored sound signal to the loudspeaker.

The output may be of fixed duration, for a few seconds, or it may be looped and play continuously until the lid mechanism is closed. The output may also consist of any combination of music, spoken or sung words and sound effects.

The output device 50 in this embodiment limits the sensory perceptible outputs to audible effects. However alternative embodiments can be envisaged where the output device can give a visual effect. Some non-limiting examples would be, L.E.Ds, liquid crystal and other related display devices, colored bulbs, projected images for example onto the ceiling or wall of the restroom and holographic displays. These may be used solely or if two or more output devices are included, integrated with a sound output similar to the arrangement in FIG. 1, to create a complete audiovisual experience for the child using the wipes.

Figure 3:
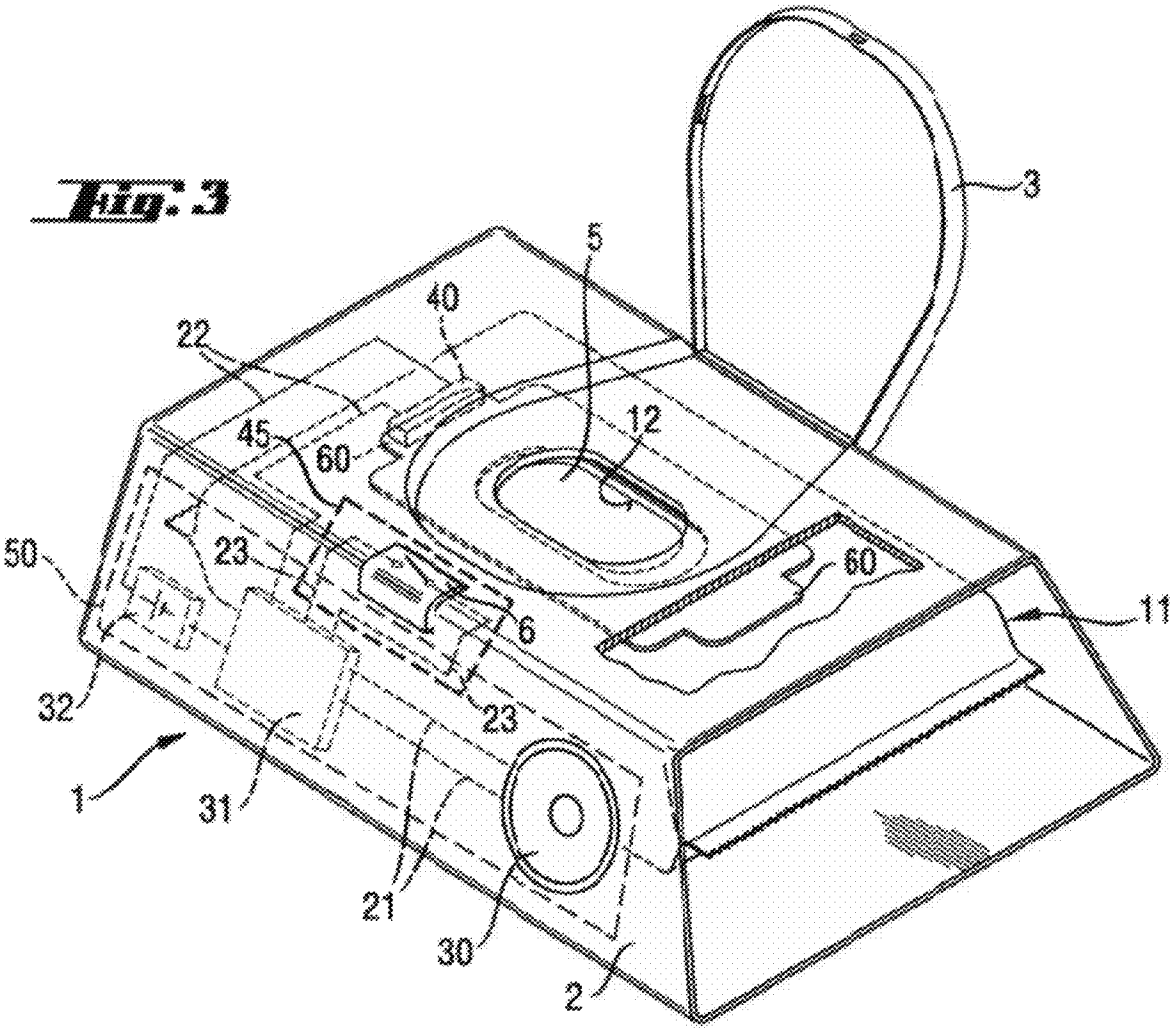
FIG. 3 shows an alternative embodiment of the container of the invention wherein the compatibility sensor operates via mechanical means.
Figure 4:
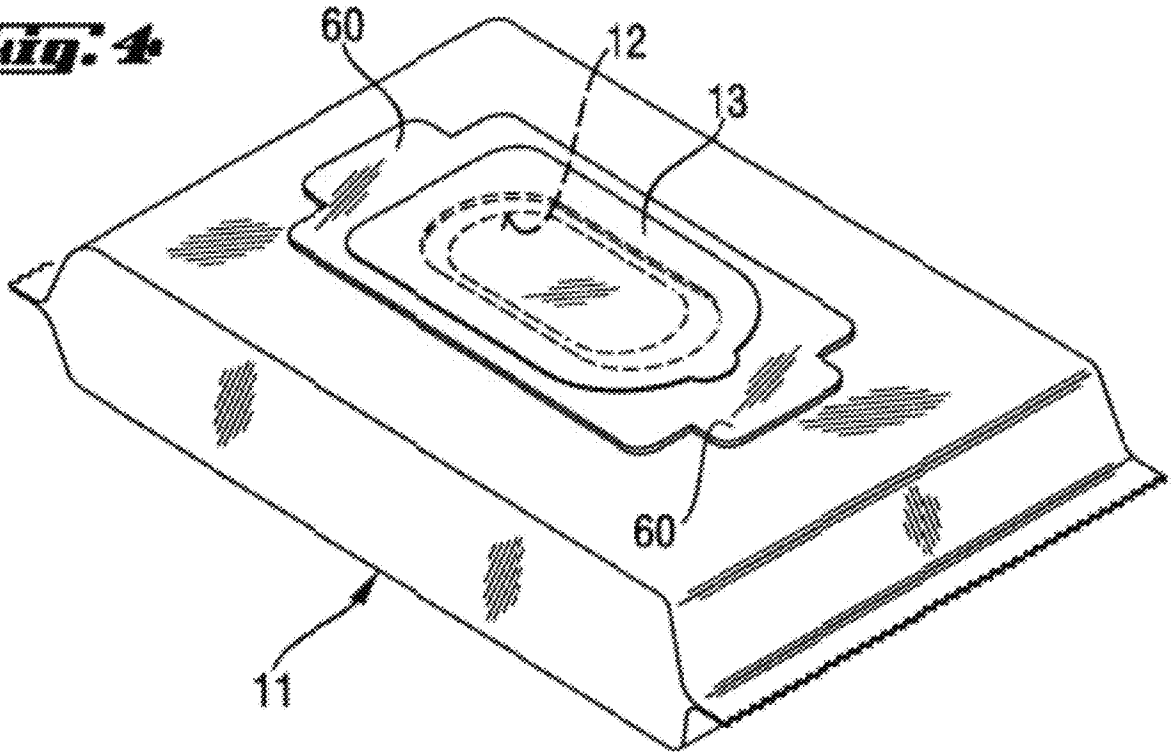
FIG. 4 shows a refill pack of wipes with a compatibility actuator that will interact with the compatibility sensor of the container in FIG. 3.

FIGS. 3 and 4 show an alternative embodiment of a container and refill pack to fit the invention. This embodiment has a mechanical interaction between compatibility actuator 60 and compatibility sensor 40.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container suitable for a pack of wipes; said pack of wet wipes containing at least one compatibility actuator and said container comprising:

i) at least one compatibility sensor ii) at least one output device capable of producing a sensory perceptible effect;

iii) at least one triggering device; and iv) a control unit electrically connected to said at least one compatibility sensor, said at least one output device, and said at least one triggering device, wherein:

said at least one output device is rendered operational only when said pack of wet wipes is inserted into said container such that said compatibility actuator interacts with said at least one compatibility sensor to complete an electrical circuit between said compatibility sensor and said control unit; and said at least one output device is activated by the operation of said at least one triggering device.

2. The container of claim 1 wherein the interaction between the said compatibility sensor and compatibility actuator is electrical, magnetic or mechanical.

3. The container of claim 1 wherein the said triggering device comprises the lid opening mechanism of the container, a motion sensor, or a push button switch.

4. The container of claim 1 wherein said sensory perceptible effect produced by said output device comprises of music, sound effects, spoken words and combinations thereof.

5. The container of claim 1 wherein said sensory perceptible effect produced by said output device comprises a light, a visual display screen, a projected image, a hologram and combinations thereof.

6. The container of claim 1 further comprising a lid that is movable between a closed position and an open position, wherein the lid covers and seals an opening when the lid is positioned in the closed position.

7. The container of claim 6, further comprising a button that secures the lid in the closed position or releases the lid from the closed position, wherein the button further acts as the at least one triggering device.

8. The container of claim 1, wherein the container further comprises a top section and a removable base section secured to the top section, wherein the removable base section is removed from the top section to allow access to insert the pack of wet wipes.

9. A wet wipes kit comprising:

a container adapted to accept packs of wet wipes comprising:

at least one compatibility sensor, at least one output device capable of producing a plurality of sensory perceptible effects when rendered operational and activated, at least one triggering device configured to activate operation of the at least one output device, and a control unit electrically connected to the at least one compatibility sensor, the at least one output device, and the at least one triggering device;

a first pack of wet wipes comprising a packaging structure comprising a flexible material, a plurality of wet wipes arranged in a stacked configuration, and a first compatibility actuator capable of interacting with the at least one compatibility sensor of the container when the first pack of wet wipes is inserted into the container to render the at least one output device operational to complete an electrical circuit between said compatibility sensor and said control unit; and a second pack of wet wipes comprising a packaging structure comprising a flexible material, a plurality of wet wipes arranged in a stacked configuration, and a second compatibility actuator capable of interacting with the at least one compatibility sensor of the container when the second pack of wet wipes is inserted into the container to render the at least one output device operational to complete an electrical circuit between said compatibility sensor and said control unit;

wherein:

the first pack of wet wipes renders operational a first output response of the at least one output device producing a first sensory perceptible effect;

the second pack of wet wipes renders operational a second output response of the at least one output device producing a second perceptible effect.

10. The wet wipes kit of claim 9, wherein the first output response relates to instructions for disposal of wet wipes in the first pack of wet wipes and the second output response relates to instructions for disposal of wet wipes in the second pack of wet wipes.

11. The wet wipes kit of claim 9, wherein the container further comprises an opening through which wet wipes are dispensed, a lid that is movable between a closed position and an open position, wherein the lid covers and seals the opening when the lid is positioned in the closed position, and a button that secures the lid in the closed position or releases the lid from the closed position.

* * * * *